US009630034B2

(12) United States Patent
Stewart

(10) Patent No.: US 9,630,034 B2
(45) Date of Patent: Apr. 25, 2017

(54) METHOD AND APPARATUS FOR CONTROLLED EMERGENCY DESCENT

(71) Applicant: AHS Rescue, LLC, Phoenix, AZ (US)

(72) Inventor: Dale Stewart, Phoenix, AZ (US)

(73) Assignee: AHS Rescue, LLC, Phoenix, AZ (US)

( * ) Notice: Subject to any disclaimer, the term of this patent is extended or adjusted under 35 U.S.C. 154(b) by 168 days.

(21) Appl. No.: 14/615,295

(22) Filed: Feb. 5, 2015

(65) Prior Publication Data

US 2015/0217149 A1 Aug. 6, 2015

Related U.S. Application Data

(60) Provisional application No. 61/935,909, filed on Feb. 5, 2014.

(51) Int. Cl.

| | |
|---|---|
| ***A62B 1/00*** | (2006.01) |
| ***A62B 35/00*** | (2006.01) |
| ***A62B 1/02*** | (2006.01) |
| ***A62B 1/18*** | (2006.01) |
| ***A62B 1/06*** | (2006.01) |

(52) U.S. Cl.

CPC ..... *A62B 35/0075* (2013.01); *A62B 1/02* (2013.01); *A62B 1/06* (2013.01); *A62B 1/18* (2013.01); *A62B 35/0006* (2013.01)

(58) Field of Classification Search

CPC . A62B 35/00; A62B 35/0006; A62B 35/0025; A62B 35/0037; A62B 35/0043; A62B 35/0056; A62B 35/005; A62B 35/0075; A62B 1/00; A62B 1/02; A62B 1/04; A62B 1/06; A62B 1/08; A62B 1/10; A62B 1/18

USPC ..... 182/10, 11

See application file for complete search history.

(56) References Cited

U.S. PATENT DOCUMENTS

| | | | | | |
|---|---|---|---|---|---|
| 38,078 | A * | 3/1863 | Commoss | A62B 1/02 | 182/10 |
| 276,090 | A * | 4/1883 | Sperry | A62B 1/18 | 102/504 |
| 293,177 | A * | 2/1884 | Joyce | A62B 1/02 | 182/10 |
| 293,322 | A * | 2/1884 | Griswold | A62B 1/02 | 182/10 |
| 338,843 | A * | 3/1886 | Ilse | A62B 1/02 | 104/113 |
| 390,446 | A * | 10/1888 | Bruce | A62B 1/02 | 104/113 |

(Continued)

*Primary Examiner* — Daniel Cahn

(74) *Attorney, Agent, or Firm* — The Noblitt Group, PLLC

(57) ABSTRACT

Methods and apparatus for an emergency descent system according to various aspects of the present technology may comprise a cable connector non-slidably connected to an emergency escape cable and a housing connected to the cable connector and configured to enclose a controlled descent system and at least a portion of a length of rope. The housing may comprise an outer protective layer, an inner wall section substantially enclosed by the outer protective layer forming an open interior portion, and a cover configured to be selectively attached to an upper portion of the outer protective layer. The cover may be configured to be selectively attached to an upper portion of the outer protective layer. The cover may be configured to cover at least a portion of the controlled descent system and protect the open interior portion from environmental conditions.

8 Claims, 5 Drawing Sheets

(56) References Cited

U.S. PATENT DOCUMENTS 603,781 A * 5/1898 Anderson ..... A62B 1/10 182/237
734,440 A * 7/1903 Smith ..... A62B 1/10 182/236
775,157 A * 11/1904 Watt ..... A62B 1/10 182/236
845,181 A * 2/1907 Legere ..... A62B 1/10 182/241
1,556,555 A * 10/1925 Brown ..... A62B 1/02 104/113
1,859,180 A * 5/1932 Thiel ..... B63C 9/00 104/113
2,321,248 A * 6/1943 Rose ..... A62B 1/02 104/113
2,567,278 A * 9/1951 Finocchiaro ..... A62B 1/02 182/11
2,670,890 A * 3/1954 Hodge ..... A62B 1/02 182/10
3,026,959 A * 3/1962 Sweigart ..... A62B 1/02 182/11
3,459,276 A * 8/1969 Kiichiro ..... A62B 1/06 182/72
3,759,346 A * 9/1973 Brda ..... A62B 1/14 182/7
3,807,696 A * 4/1974 Brda ..... A62B 1/14 182/192
3,826,335 A * 7/1974 Allen ..... B66B 9/06 182/10
3,860,092 A * 1/1975 Holmes ..... A62B 1/02 182/101
4,056,167 A * 11/1977 Bonafos ..... B66C 21/00 182/10
4,111,281 A * 9/1978 Jacobs ..... A62B 1/02 182/10
4,301,892 A * 11/1981 Arce ..... A62B 1/10 182/233
4,434,869 A * 3/1984 Roop ..... A62B 1/02 182/10
4,474,263 A * 10/1984 Christopher ..... B66B 9/00 182/10
4,538,704 A * 9/1985 Forrest ..... A62B 1/02 182/10
4,580,658 A * 4/1986 Brda ..... A62B 1/14 182/193
4,919,231 A * 4/1990 Klokseth ..... A62B 1/18 182/5
5,107,956 A * 4/1992 Constantinis ..... A62B 1/06 182/5
5,305,852 A * 4/1994 Klokseth ..... A62B 1/06 182/231
5,653,350 A * 8/1997 Maki ..... B66C 1/585 212/197
5,927,438 A * 7/1999 Ostrobrod ..... A62B 1/08 182/192
6,382,355 B1 * 5/2002 Kowalewski ..... A63B 27/00 182/133
7,246,712 B2 * 7/2007 Baker ..... B66C 21/04 212/78
7,942,242 B1 * 5/2011 O'Connor ..... A62B 1/14 182/189
7,963,370 B2 * 6/2011 Hwang ..... A62B 1/10 182/236
8,162,365 B2 * 4/2012 Escobar ..... A62B 99/00 294/140
9,517,362 B1 * 12/2016 Siegel ..... A62B 1/14
2006/0231332 A1 * 10/2006 Ellingson ..... A62B 1/02 182/10
2012/0318609 A1 * 12/2012 Hartman ..... A62B 1/04 182/10
2013/0048423 A1 * 2/2013 Smith ..... B61B 11/002 182/10
2013/0240298 A1 * 9/2013 Naylor ..... A62B 35/00 182/231
2014/0263141 A1 * 9/2014 May ..... B66C 23/62 212/242
2016/0175622 A1 * 6/2016 Verstegen ..... A62B 1/10 254/274

* cited by examiner

METHOD AND APPARATUS FOR CONTROLLED EMERGENCY DESCENT

CROSS-REFERENCES TO RELATED APPLICATIONS

This application claims the benefit of U.S. Provisional Patent Application No. 61/935,909, filed Feb. 5, 2014, and incorporates the disclosure of the application by reference.

BACKGROUND OF INVENTION

Currently methods and products for an emergency descent system do not provide sufficient levels of protection for users needing to rapidly descent from an elevated platform, such as at or near the top of an oil platform or derrick, in an emergency situation. Typical emergency escape systems require the user to manually set up and connect a descent kit to the escape line prior to descending from the elevated platform, which can lead to delays in a time sensitive situation. Other escape systems require the user to ride a cart-like device down the escape line. These cart-like devices do not include any type of safety tethering system for the user after leaving the elevated platform. In addition, the speed of the can-like devices as they descend on the emergency cable is only controlled by a hand brake system. As a result, the user is exposed to potentially uncontrollable descending speeds and may fall from the escape system.

SUMMARY OF THE INVENTION

Methods and apparatus for an emergency descent system according to various aspects of the present technology may comprise a cable connector non-slidably connected to an emergency escape cable and a housing connected to the cable connector and configured to enclose a controlled descent system and at least a portion of a length of rope. The housing may comprise an outer protective layer, an inner wall section substantially enclosed by the outer protective layer forming an open interior portion, and a cover configured to be selectively attached to an upper portion of the outer protective layer. The cover may be configured to be selectively attached to an upper portion of the outer protective layer. The cover may be configured to cover at least a portion of the controlled descent system and protect the open interior portion from environmental conditions.

BRIEF DESCRIPTION OF THE DRAWINGS

A more complete understanding of the present invention may be derived by referring to the detailed description when considered in connection with the following illustrative figures. In the following figures, like reference numbers refer to similar elements and steps throughout the figures.

DETAILED DESCRIPTION OF EXEMPLARY EMBODIMENTS

The present technology may be described in terms of functional block components and various processing steps. Such functional blocks may be realized by any number of components configured to perform the specified functions and achieve the various results. For example, the present technology may employ various types of pivoting links, connectors, couplings, harnesses, ropes, cables, and the like, which may carry out a variety of functions. In addition, the present technology may be practiced in conjunction with any number of systems such as commercial and/or industrial evacuation systems and the system described is merely one exemplary application for the technology. Further, the present technology may employ any number of conventional techniques for repelling, climbing, and descending.

Methods and apparatus for controlled emergency descent according to various aspects of the present technology may operate in conjunction with any suitable cable system and/or evacuation system. Various representative implementations of the present technology may be applied to any evacuation system for drilling rigs, derricks or similarly elevated platforms.

Figure 1:
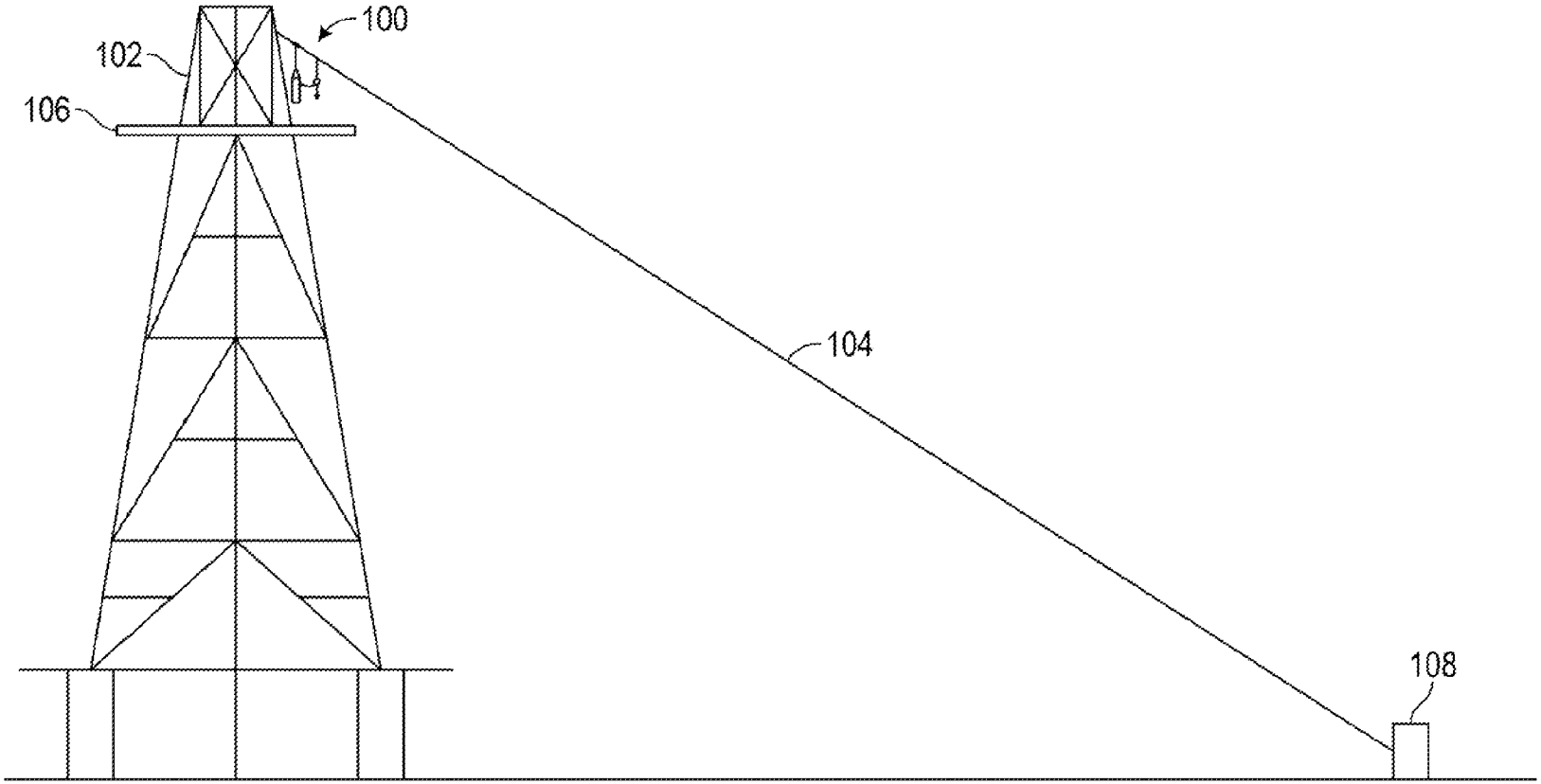
FIG. 1 representatively illustrates an elevated platform and evacuation system in accordance with an exemplary embodiment of the present invention.

Referring now to FIG. 1, in an exemplary embodiment of the present technology; an emergency descent system 100 may be configured to be positioned on a drilling rig 102 having an elevated platform 106 and an emergency cable 104. The emergency cable 104 may comprise any suitable cable system adapted to provide a direct zip line-like path from the elevated platform 106 to a ground location 108 or other designated location or safe zone positioned below the elevated platform 106. For example, during a fire condition or similar unsafe condition, the elevated platform 106 may be directly above the fire such that a worker positioned on the elevated platform 106 cannot safely descend from the elevated platform 106 by an elevator or stairs. Therefore, the emergency cable 104 may be used to exit the elevated platform 106 such that the worker is not exposed to the lire condition.

The emergency cable 104 may comprise a threaded metal cable of between one-quarter of an inch and three-quarters of an inch thickness coupled on a first end to the drilling rig 102 and a ground location 108 on a second end of the emergency cable 104. The emergency cable 104 may be part of an existing evacuation system installed during erection of the drilling rig 102 or the emergency cable 104 may be part of the emergency descent system 100 and installed substantially simultaneously with the emergency descent system 100.

Figure 2:
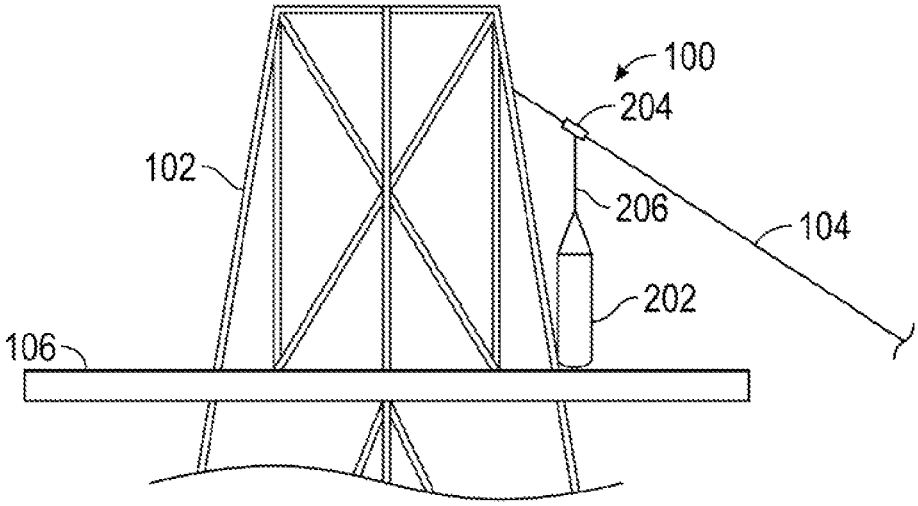
FIG. 2 representatively illustrates a detailed, view of the elevated platform and the emergency descent system in accordance with an exemplary embodiment of the present invention.
Figure 3:
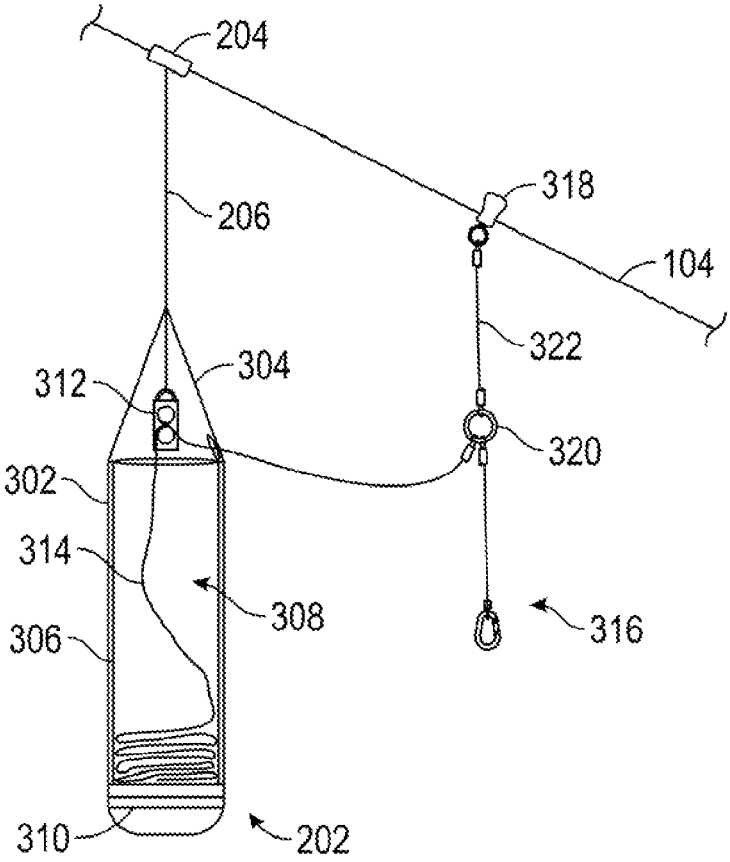
FIG. 3 representatively illustrates a detailed view of the emergency descent system in accordance with an exemplary embodiment of the present invention.
Figure 5:
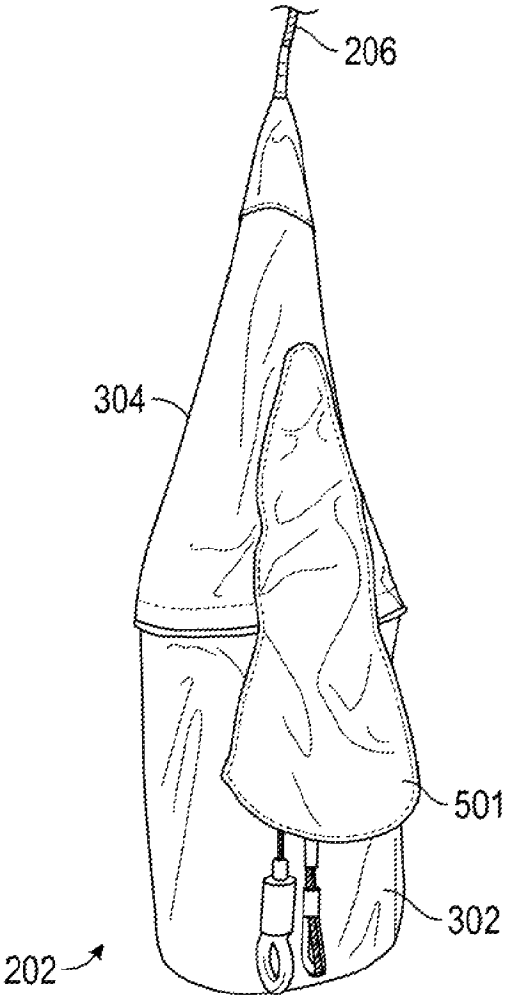
FIG. 5 representatively illustrates a detailed view of the cover attached to the housing in accordance with an exemplary embodiment of the present invention.

Referring now to FIGS. 2, 3, and 5, the emergency descent system 100 may comprise a housing 202 configured to contain one or more components of the emergency descent system 100. The housing 202 may be fixedly coupled to the emergency cable 104 by a cable connector 204 such that the emergency descent system 100 is at least semi-permanently positioned proximate to an emergency exit point from the elevated platform 106. In one embodiment, the cable connector 204 may comprise any suitable mechanism or device configured to be non-slidably connected to the emergency cable 104. For example, the cable connector 204 may comprise a wire-pulling or cable grip, such as a Haven's® grip.

Referring now to FIGS. 2 and 3, the housing 202 may be connected to the cable connector 204 by a first cable 206 extending outward from an upper portion of the housing 202 such that the housing 202 may hang or otherwise be at least partially suspended from the emergency cable 104. The housing 202 may hang or be suspended from the emergency cable 104 such that there is a clearing between the lower portion of the housing 202 and the elevated platform 106. In another embodiment, the first cable 206 may comprise a length such that the housing 202 may rest upon a portion, of the elevated platform 106 when the housing 202 is connected to the cable connector 204.

In another embodiment, the housing 202 may comprise any suitable system or device configured to increase the visibility of the housing 202 or the emergency descent system 100 in low visibility conditions such as those involving dust and/or smoke. For example, the housing 202 may comprise a reflective or colored material configured to increase the visibility of the housing 202 or emergency descent system 100.

The housing 202 may comprise an inner wall section 306 suitably configured to store additional components and provide the additional components with protection from environmental elements such as the heat, dust, precipitation, ultra-violet light, and the like which may adversely affect the performance and/or mechanical integrity of the additional components and/or the emergency descent system as a whole. In one embodiment, the housing 202 may comprise a container comprising an outer protective layer 302 covering the inner wall section 306 to form an open interior portion 308. The housing 202 may further comprise a cover 304 coupled to the outer protective layer 302 and configured to provide access to the open interior 308.

The inner wall section 306 may be configured to provide at least a portion of the structural support to the housing 202. The inner wall section 306 may comprise any suitable device or system for forming vertical sidewalls of the housing 202 or for providing support for the open interior portion 308. The inner wall section 306 may comprise any suitable size or shape allowing for the storage and/or organization of one or more components of the emergency descent system 100.

The inner wall section 306 may comprise any suitable material such as plastic, wood, metal, composite, or the like. For example, in one embodiment, the inner wall section 306 may comprise substantially open-ended rigid tubular plastic material having a radius of between three and twelve inches and a height of between six and twenty-four inches. An upper end portion of the inner wall section 306 formed by the rigid tubular plastic material may be open to allow access to the open interior portion 308. A lower end portion of the inner wall section 306 may be enclosed outer protective layer 302 such that a barrier is created between the lower end portion of the inner wall section 306 and a fire protection layer 310. The inner wall section 306 may be formed using a single piece of material or may be pieced together using a combination of the same and/or different materials.

In an alternative embodiment, the inner wall section 306 may comprise a box-like shape made from a metallic material. In yet a third embodiment, the inner wall section 306 may comprise any suitable system or device to allow the inner walls section 306 to collapse upon itself or otherwise reduce its size. Once collapsed, or otherwise reduced in size, the inner wall section 306 may still be suitably configured to store and/or organize one or more components of the emergency descent system 100.

The inner wall section 306 may further comprise any system or device suitably configured to organize and/or store various components of the emergency descent system 100 for ease of access and/or protection from external sources. For example, the inner wall section 306 may comprise a plurality of pockets, mounts, hooks, and the like suitably configured to hold a rope 314, a controlled descent device 312, a multi-connector 320, a pulley 318, and/or a personal connection device 316.

The outer protective layer 302 may be configured to be fit around and substantially enclose the inner wall section 306 and be suitably adapted to provide protection against damage from elements such as ultra-violet light, precipitation, fire, dust, and the like. For example, in one embodiment, the outer protective layer 302 may comprise a water repelling fire resistant polyester based fabric material that is configured to withstand exposure to direct sunlight and other weather conditions without significant degradation to its protective ability and/or mechanical integrity over a period of time of up to five or six years. The outer protective layer 302 may also be configured to be securely attached to the inner wall section 306 by any suitable method such as matable clips, tabs, adhesives, or the like. Alternatively, the inner wall section 306 may be incorporated into a weaving of the outer protective layer 302 such that the inner wall section 306 and the outer protective layer 302 form a substantially unitary structure.

In another embodiment, a space between the outer protective layer 302 and the inner wall section 306 may comprise any system or device suitably configured to provide protection against damage from elements such as ultra-violet light, precipitation, fire, dust, and the like. For example, a layer of lire repellent or fire retardant material may be placed between the outer protective layer 302 and the inner wall section 306 for increased protection from heat or other elements. Similarly, the space between the lower end portion of the inner wall section 306 and the fire protection layer 330 may also comprise any system or device suitably configured to provide protection against damage from elements.

The cover 304 may comprise any suitable device configured to cover, seat, or at least substantially enclose the open interior portion 308 of the housing 202. The cover 304 may be configured to be selectively attached to an upper section of the outer protective layer 302 to shield the open interior portion 308 from direct exposure to at least some environmental conditions such as heat, dust, precipitation, ultra-violet light, and the like. For example, in one embodiment, a lower inward facing portion of the cover 304 may comprise a connector such as a snap, hook and loop fastener, zipper, or the like that may be selectively coupled to a mating connector on an exterior facing upper portion of the outer protective layer 302. In one embodiment, the cover 304 may comprise the same material as the outer protective layer 302. The cover 304 may be selectively attached to or otherwise coupled to the outer protective layer 302 by any suitable method or device.

Figure 7:
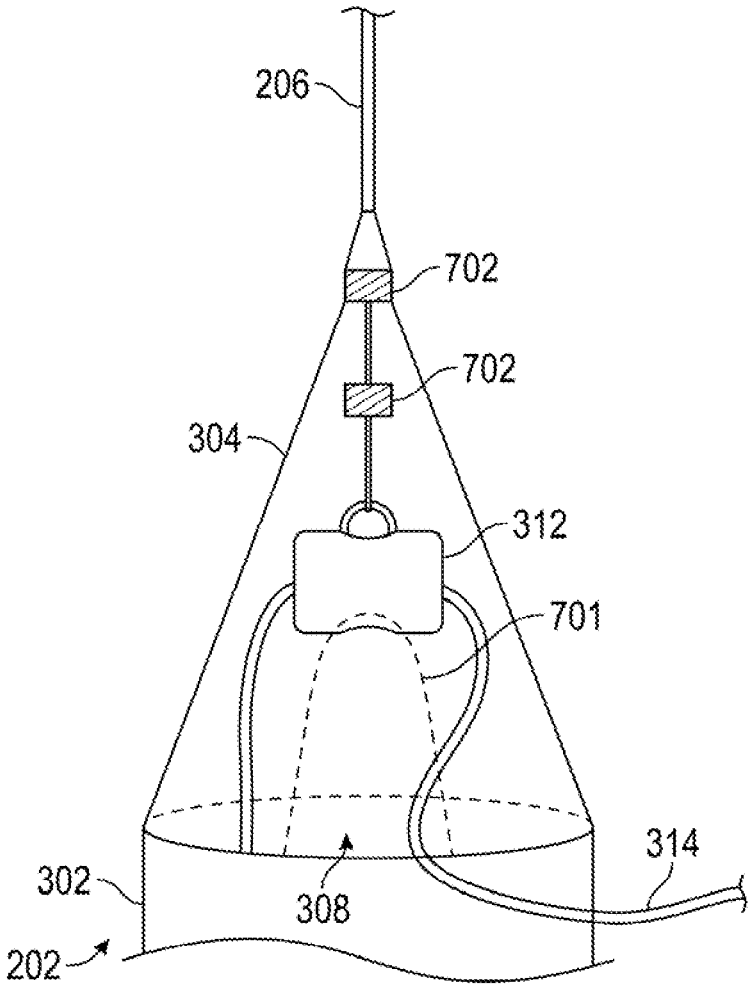
FIG. 7 representatively illustrates a detailed view of the cover of the present invention.

Referring now to FIGS. 5 and 7, the cover 304 may also comprise an opening 701 suitably configured to provide access to the open interior portion 303 without having to detach the cover 304 from the outer protective layer 302 or otherwise manipulating the housing 202 to get access to the open interior portion 308. For example, the opening may comprise a hole in the cover 304 and a flap 501 suitably configured to cover the hole. The flap 501 may extend downward past the upper portion of the outer protective layer 302 of the housing 202 without being directly attached to the outer protective layer 302 and/or the housing 202. The flap 501 may be suitably configured such that when the flap 501 extends beyond the lower portion of the cover 304, the flap 501 covers at least a portion of the multi-connector 320, the second cable 322, and/or the personal connection device 316.

In one embodiment, the flap 501 may be configured to be selectively attached to the cover 304 to provide shielding to the opening of the cover 304. The flap 501 may be attached to the cover 304 using any suitable system or device such as clips, ties, tapes, adhesives, fasteners, and the like. A lower portion of the flap 501 may comprise any system or device suitably configured to prevent the flap 501 from detaching from the housing 202 when the flap 501 extends past the lower portion of the cover 304. For example, the outer protective layer 302 of the upper portion of the housing 202 and an interior side of the flap 501 may comprise complementary connection devices such that the flap 501 is secured to the housing 202. The complementary connection devices may comprise adhesives, hooks, loop and fasteners, ties, clips, and the like. The interior side of the flap 501 may further comprise any system or device suitably configured to hold one or more components of the emergency descent system 100. For example, the interior side of the flap 501 may be configured into a pouch-like structure to hold at least a portion of the personal connection device 316, the multi-connector 320, and/or the second cable 322. The flap 501 may comprise any material suitably configured to provide the cover 304 and/or the housing 202 with protection from elements such as plastic, rubber, composite, and the like.

Referring now to FIGS. 3,5, and 7, in one embodiment, the cover 304 may comprise a cone-like shape, wherein a lower section of the cover 304 is suitably configured to match the circumference or size of the opening of the upper portion of the outer protective layer 302 and/or the inner wall section 306. The upper section of the cover 304 may be suitably configured to fit around the first cable 206 and at least partially seal off the open interior portion 308 from external elements such as precipitation, dust, pests, and the like which may adversely affect the performance and/or the mechanical integrity of the emergency descent system 100. For example, sealing the cover 304 around the first cable 206 may be accomplished using any method or device suitably configured to create a seal. For example, in one embodiment, ties can be used to secure the cover 304 around the first cable 206. In another embodiment, any suitable system or device may be used such as ties, tapes, sealants, clips, adjustable rings and the like. The system or device securing the cover 304 to the first cable 206 may comprise any material suitably configured to provide a long-lasting seal while being exposed, to a variety of conditions such as heat, rain, snow, ice, wind, ultra-violet light, dost, and the like. For example, a plurality of swedges 702 may be coupled to the first cable 206. The upper section of the cover 304 may be suitably configured to be coupled to the first cable 206 at a location above or between the plurality of swedges 702. Coupling the upper section of the cover 304 to the first cable 206 may comprise circumscribing or otherwise fitting the upper section of the cover 304 around the plurality of swedges 702 to create a seal-like fitting between, the upper section, of the cover 304 and the first cable 206. The plurality of swedges 702 may be suitably configured to prevent the cover 304 from slipping down or otherwise becoming uncoupled from the first cable 206. The cover 304 may be secured to the plurality of swedges 702 using any suitable system or device such as ties, tapes, sealants, clips, adjustable rings and the like.

The cover 304 may comprise any material suitably configured to provide the emergency descent system 100 with protection from elements such as heat, dust, precipitation, wind, snow, ice, and the like. The cover 304 may comprise the same or different water repelling fire resistant polyester based fabric material as the housing 202.

A lower portion of the housing 202 may comprise a plurality of insulating layers configured to provide the housing 202 with increased resistance to elevated temperatures and/or other elemental effects. For example, one layer may comprise a fire protection layer 310 suitably configured to resist elevated temperatures and/or direct exposure to flames for a period of up to several minutes while the emergency descent system 100 is in use. The fire protection layer 310 may comprise any suitable system or device for resisting a lire. For example, the fire protection layer 310 may comprise one or more layers of fire resistant or lire retardant materials configured to protect the components stored within the open interior portion 308 from the effects of a fire below or along the Boor of the elevated platform 106.

In other embodiments, the tower portion of the housing 202 may comprise additional layers to the fire protection layer 310. For example, another layer may be included with the lower portion of the housing 202 to provide the housing with increased protection from cold, and/or moisture. The lower portion of the housing 202 may be suitably configured to be customizable. For example, depending on the location and conditions of where die emergency descent system 100 is deployed, different layers may be desired.

Referring now to FIG. 3, the open, interior portion 308 may be suitably configured to store various components such as a controlled descent device 312, rope 314, a pulley 318, a personal connection device 316, and a multi-connector 320. For example, in one embodiment, the controlled descent device 312 may be connected to the first cable 206 such that the controlled descent device 312 hangs below the emergency cable 104 proximate to the connection point of the cable connector 204 to the emergency cable 104. The controlled descent device 312 may further be connected to the rope 314 such that the rope 314 may be fed through the controlled descent device 312.

The controlled descent device 312 may be configured to provide a controlled descent for a user from the elevated platform 106. The controlled descent device 312 may comprise any suitable system or device for controlling a rate of descent of the user along the emergency cable 104. In one embodiment, the controlled descent device 312 may comprise a device configured to allow the rope 314 to be fed through the controlled descent device 312 at a substantially constant rate. For example, the controlled descent device 312 may comprise a geared pulley system suitably configured to allow a maximum feed rate of between two and twelve feet per second when subjected to a tensile force of up to about 400 pounds on one end of the rope 314.

In other embodiments, the controlled descent, device 312 may comprise a variable and/or user defined feed rate. For example, a slower or faster feed rate may be necessary depending on the configuration, location, and external conditions of the drilling rig 102, height of the elevated platform 106, and/or a position of the ground location 108.

The multi-connector 320 may comprise any suitable system or device configured to be coupled together two or more components of the emergency descent system 100 to the emergency cable 104. In one embodiment, the multi-connector 320 may be suitably configured to be coupled to a first end of the tope 314 and the personal connection device 316. The multi-connector 320 may also be configured to be selectively attached to the emergency cable 104 by any suitable device configured to move downward along the emergency cable 104 such as a pulley 318. For example, the multi-connector 320 may comprise a circular key ring-like device such that components can be coupled to, and linked together, by key ring-like device. The multi-connector 320 may be configured such that components attached to it may slide around the perimeter of the multi-connector 320.

In other embodiment, the multi-connector 320 may be pre-configured with specific attachment locations and/or attachment configurations. For example, the multi-connector 320 may designate a special location for the connection of the rope 314, the personal connection device 316, and/or a second cable 322. Likewise, the multi-connector 320 may be configured such that the rope 314 can only be attached at a specific connector located on the multi-connector 320.

The rope 314 may comprise any suitable material capable of withstanding the weight of between one and four users such as that commonly used for climbing and repelling. The first end of the rope 314 may be connected to the multi-connector 320 and a second end of the rope may be positioned within the open interior portion 308. The second end of the rope 314 may be connected to an interior portion of the housing 202 or remain unconnected to the housing but be configured such that the second end cannot pass through the controlled descent device 312. For example, the second end could be configured into a knot such that the size of the knot prevents the second end of the rope from being fed through the controlled descent device 312. Alternatively, a stopper may be suitably configured to be coupled to the second end of the rope 314 such that the stopper may prevent the second end of the rope 314 from being fed through the controlled descent device 312. The stopper may comprise any suitable system or device that is configured to be attached to the end of a length of rope. The stopper may be made from the same material as the rope or a different material such as plastic, metal, wood, composite, or the like.

The rope 314 may comprise a length sufficient to allow the user to completely descend along emergency cable 104 to the ground location 108. The length of rope 314 between the second end and the controlled descent device 312 may be stored within the open interior portion 308 while the length of rope 314 between the first end and the controlled descent device 312 may be stored at least temporarily outside of the housing 202 and/or under the flap 501 such that at least one of the multi-connector 320, the personal connection device 316, and the pulley 318 may be easily accessed prior to use.

The rope 314 may be treated with any system or device suitably configured to increase the rope's 314 performance and/or quality. For example, the rope 314 may be coated in a material, to prevent the rope 314 from drying up when the housing 202 is placed in a dry environment. Likewise, the rope 314 may be treated with a material to prevent the rope 314 from freezing and cracking when the housing 202 is placed in cold environments.

In another embodiment, the rope 314 may be coated in a material that will allow the rope to be exposed to heat or fire for an extended period of time. For example, the rope 314 may be coated in a fire retardant material that will allow the rope to be exposed, to fire and/or heat for extended periods of time while multiple users descend from, the elevated platform 106.

In another embodiment, the emergency descent system 100 maybe comprise any suitable system or device configured to retract the rope from the ground location 108 back to the location of the housing 202. For example, a rope retractor may be placed within the housing 202 such that after one user descends from the elevated platform 106 to the ground location 108, a second user can retract that length of rope 314 to use themselves. The rope retractor may be configured to be replaced within the housing 202 to shield the rope retractor from environmental damage. The rope retractor may be manually operated via a crank or pulley system or the rope refractor may be automatic using a spring or motor driven system. The rope retractor may be accessed via the opening of the cover 304.

The pulley 318 may be configured to roll or otherwise move along the emergency cable 104 during the descent process. The pulley 318 may comprise any suitable system or device for facilitating the transfer of the user along the emergency cable 104 such as a pulley, shackle, carabiner, pivoting link, and the like. For example, in one embodiment, the pulley 318 may comprise an aluminum pulley configured to roll along a rope or cable of up to two inches in diameter.

The pulley 318 may be connected to the multi-connector 320 by any suitable method such as by the second cable 322. The pulley 318 may also be configured to be selectively attached to the emergency cable 104. For example, in one embodiment, the pulley 318 may be configured with a pivoting surface suitably adapted to receive the emergency cable 104 when pivoted to a first position and lock the pulley to the emergency cable 104 when the surface is pivoted to a second position.

The personal connection device 316 may be configured to be selectively attached to the user such that the user is securely connected to the emergency descent system 100. The personal connection device 316 may comprise any suitable system or device for connecting the user to the emergency descent system 100. In one embodiment, a first end of the personal connection device 316 may be connected to the multi-connector 320 and a second end of the personal connection device 316 may comprise a coupling suitably configured to be selectively connected to the user. For example, the coupling may comprise a device such as pivoting link, a snap hook, or the like that may be quickly coupled to a safety harness worn by the user.

Figure 4:
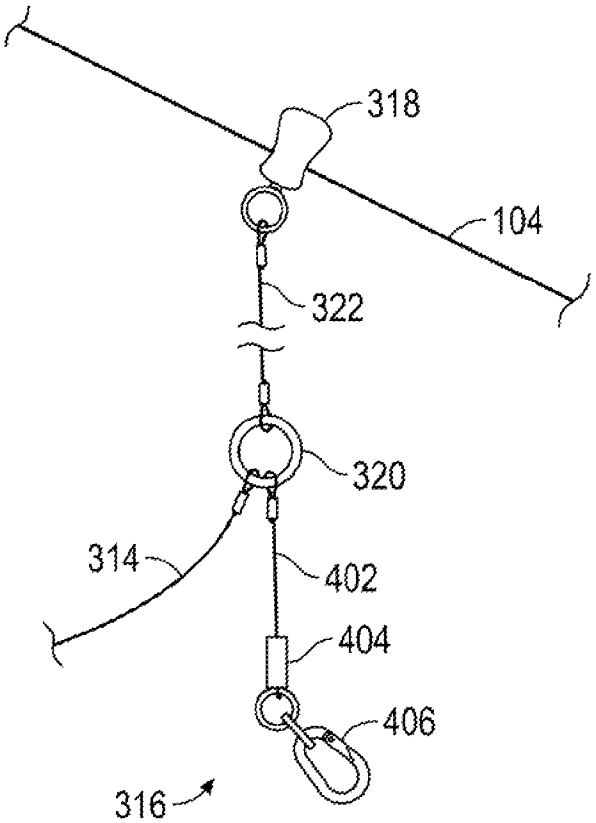
FIG. 4 representatively illustrates a detailed view of a personal connection system in accordance with an exemplary embodiment of the present invention.

Referring now to FIG. 4, in another embodiment, the personal connection device 316 may comprise a third cable 402, a cable glider 404, and a pivoting link 406. The third cable 402 may be connected to the multi-connector 320 at a first end and a second end of the third cable 402 may be connected to the cable glider 404. The cable glider 404 may comprise a system or device that may be selectively slid along the third cable 402 to position the pivoting link 406 a desired distance from the multi-connector 320. For example, the cable glider 404 may be positioned at a point along the third cable such that the pivoting link 406 can be easily attached to the user's safety harness once the pulley 318 is connected, to the emergency cable 104.

Referring now to FIGS. 1, 2, 3, and 6A-E, in operation, emergency descent system 100 may be positioned on an elevated platform 106 and be fixedly connected to an emergency cable 104 extending between the elevated platform 106 and a location 108 at or near ground level or otherwise positioned below the elevated platform 106. The emergency descent system 100 may be configured as an all-in-one kit ready for connection to the emergency cable 104. For example, a housing 202 containing a controlled descent system comprising a controlled descent device 312, a length of rope 314 run through the controlled descent device 312, and a personal connection device 316 connected to the rope may be configured to be fixedly connected to the emergency cable 104 by a first cable 206 such that the emergency descent system 100 may hang or otherwise at least semi-permanently be suspended from the emergency cable 104 until an emergency situation occurs in which a user may be required to evacuate the elevated platform 106 in a rapid manner.

Referring now to FIGS. 6A-D, in the event that an emergency situation occurs, the user may access a pulley 318 connected to the personal connection device 316 contained within the housing 202 of the emergency descent system 100. The user may attach the pulley 318 to the emergency cable 104. Attaching the pulley 318 to the emergency cable 104 may expose a length of the rope 314 that is coupled to the pulley 318 by a multi-connector 320. The user may then attach the personal connection device 316 to a clip on the user's safety harness and then disconnect the user's safety harness from any safety system connecting the user to the elevated platform 106.

Figure 6A:
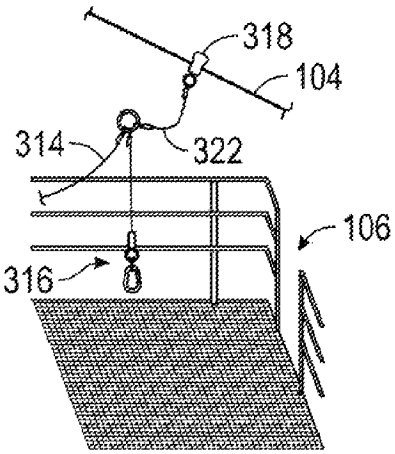
FIGS. 6A-E representatively illustrates a detailed view of a user using the emergency descent system in accordance with an exemplary embodiment of the present invention.
Figure 6B:
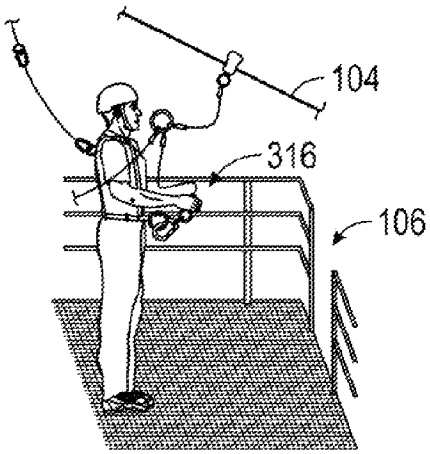
Figure 6C:
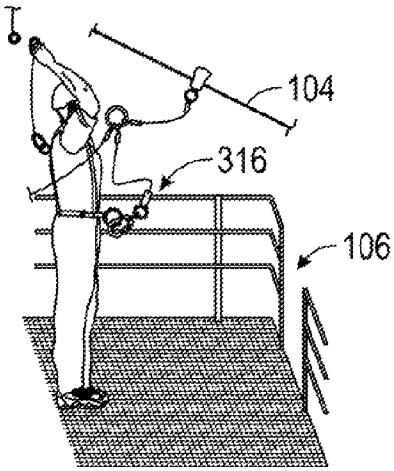
Figure 6D:
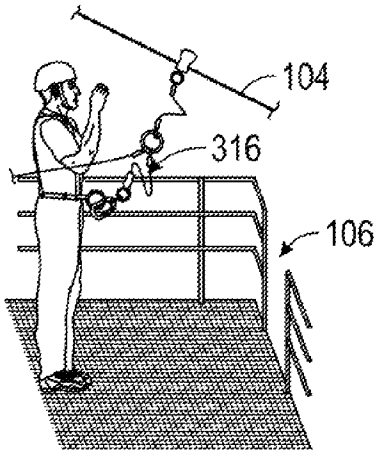
Figure 6E:
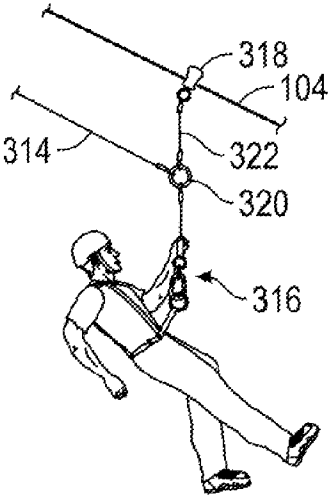

Referring now to FIG. 6E, after the user is securely connected to the personal connection device 316 and the personal connection device 316 is securely connected to the emergency cable 104, the user may step off of the elevated platform 106. Securely connecting the personal connection device 316 to the emergency cable 104 may comprise connecting the personal connection device 316 to the multi-connector 320, connecting the multi-connector 320 to a second cable 322, and connecting the second cable 322 to the pulley 318. The pulley 318 will then descend along the emergency cable 104 under the weight of the user. The controlled descent device 312 positioned within the housing 202 and/or the cover 304 may then allow for a controlled descent along the emergency cable 104 by controlling a rate in which the rope 314 is passed outward from the housing 202. As the rope 314 is fed out of the housing, the user is carried downward to safety.

In one embodiment, after descending to safety, the rope 314, the pulley 318, and the personal connection device 316 may be retracted back into the housing 202 and/or the cover 304 for use by another user.

The particular implementations shown and described are illustrative of the invention and its best mode and are not intended to otherwise limit the scope of the present invention in any way. Indeed, for the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

In the foregoing specification, the invention has been described with reference to specific exemplary embodiments. Various modifications and changes may be made, however, without departing from the scope of the present invention as set forth in the claims. The specification and figures are illustrative, rather than restrictive, and modifications are intended to be included within the scope of the present invention. Accordingly, the scope of the invention should be determined by the claims and their legal equivalents rather than by merely the examples described.

For example, the steps recited in any method or process claims may be executed in any order and are not limited to the specific order presented in the claims. Additionally, the components and/or elements recited in any apparatus claims may be assembled or otherwise operationally configured in a variety of permutations and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition, or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The invention claimed is:

1. An emergency descent system for a person positioned on an elevated platform having an emergency cable positioned between the elevated platform and a ground location, the emergency descent system comprising:

a cable connector configured to be non-slidably connected to the emergency cable at a fixed location;

a first cable having first and second ends, wherein the first end is coupled to the cable connector;

a controlled descent device coupled to the second end of the first cable such that the controlled descent device hangs from the emergency cable when the cable connector is connected to the emergency cable;

a rope extending through the controlled descent device, wherein the controlled descent device is configured to control a rate at which the rope passes through the controlled descent device;

a personal descent connection system coupled to a first end of the rope, wherein the personal descent connection system is configured to:

be selectively coupled to the emergency cable at a position lower than the cable connector; and move downward along the emergency cable towards the ground location while simultaneously pulling the rope through the controlled descent device while carrying the person in a harness; and a housing configured to:

engage at least a portion of the first cable;

enclose the controlled descent device and the rope within an open interior portion; and enclose at least a portion of the personal descent connection system.

2. An emergency descent system according to claim 1, wherein the personal descent connection system comprises:

a pulley configured to roll along the emergency cable;

a multi-connector device coupled between the first end of the rope and the pulley;

a personal connection device coupled to the multi-connector device and configured to be selectively coupled to the person.

3. An emergency descent system according to claim 1, wherein the personal connection device comprises:

a second cable coupled to the multi-connector device on a first end;

a cable glider coupled to a second end of the second cable; and a pivoting link coupled to the cable glider and configured attach to a harness worn by the person.

4. An emergency descent system according to claim 1, wherein the housing comprises:

an outer protective layer;

an inner wall section substantially enclosed by the outer protective layer and forming an open interior portion for storing at least a portion of the controlled descent system; and a cover configured to be selectively attached to an upper portion of the outer protective layer to protect the open interior portion from environmental conditions.

5. An emergency descent system according to claim 4, wherein the cover further comprises an opening configured to allow for the selective removal of a pulley from the open interior portion.

6. An emergency descent system according to claim 4, wherein the outer protective layer of the housing comprises at least one of a fire resistant and a fire retardant material.

7. An emergency descent system according to claim 1, wherein a lower portion of the housing comprises a plurality of insulating layers configured to provide the housing with increased resistance to elevated temperatures.

8. A method comprising:

providing the emergency descent system of claim 1; and connecting the cable connector to the fixed location on the emergency cable such that the cable connector cannot slide along the emergency cable.

* * * * *